US005807142A

United States Patent [19]

O'Sullivan

[11] Patent Number: 5,807,142

[45] Date of Patent: Sep. 15, 1998

[54] ELECTRICAL CONNECTOR HAVING TERMINALS WITH IMPROVED RETENTION MEANS

[75] Inventor: Michael O'Sullivan, Willowbrook, Ill.

[73] Assignee: Molex Incorporated, Lisle, Ill.

[21] Appl. No.: 644,779

[22] Filed: May 10, 1996

[51] Int. Cl.[6] ..... H01R 13/40

[52] U.S. Cl. ..... 439/733.1

[58] Field of Search ..... 439/733.1, 290, 439/291, 862

[56] References Cited

U.S. PATENT DOCUMENTS

| | | | |
|---|---|---|---|
| 3,281,760 | 10/1966 | Oshima et al. | 339/176 |
| 3,588,862 | 6/1971 | Brizzi | 339/258 |
| 3,865,462 | 2/1975 | Cobaugh et al. | 339/176 |
| 4,175,821 | 11/1979 | Hunter | 339/258 |
| 4,186,982 | 2/1980 | Cobaugh et al. | 339/17 |
| 4,217,024 | 8/1980 | Aldridge et al. | 439/733.1 |
| 4,241,970 | 12/1980 | Rider, Jr. et al. | 339/99 |
| 4,324,451 | 4/1982 | Ammon et al. | 339/176 |
| 4,429,459 | 2/1984 | Lynch | 29/881 |
| 4,583,805 | 4/1986 | Mantlik | 339/61 |
| 4,591,230 | 5/1986 | Roldan | 339/256 |
| 4,607,907 | 8/1986 | Bogursky | 339/258 |
| 4,660,915 | 4/1987 | Mantlik | 339/61 |
| 4,679,890 | 7/1987 | Fineblum | 439/884 |
| 4,740,180 | 4/1988 | Harwath et al. | 439/830 |
| 4,820,182 | 4/1989 | Harwath et al. | 439/290 |
| 4,842,528 | 6/1989 | Frantz | 439/80 |
| 4,887,976 | 12/1989 | Bennett et al. | 439/492 |
| 5,030,138 | 7/1991 | Capp et al. | 439/92 |
| 5,064,391 | 11/1991 | Buchter | 439/733 |
| 5,112,233 | 5/1992 | Lybrand | 439/79 |
| 5,190,483 | 3/1993 | Viselli | 439/751 |
| 5,290,181 | 3/1994 | Bixler et al. | 439/856 |

FOREIGN PATENT DOCUMENTS

| | | | |
|---|---|---|---|
| 0 288 248 B1 | 4/1988 | European Pat. Off. | H01R 13/422 |
| 0 638 960 A2 | 7/1994 | European Pat. Off. | H01R 13/26 |
| 0 647 986 A1 | 9/1994 | European Pat. Off. | H01R 13/41 |
| 1340607 | 12/1962 | France . | |
| 146271/85 | 9/1991 | Japan . | |
| 255564 | 8/1995 | Taiwan | H01R 9/03 |

*Primary Examiner*—Khiem Nguyen
*Assistant Examiner*—Eugene G. Byrd
*Attorney, Agent, or Firm*—Charles S. Cohen

[57] ABSTRACT

An electrical connector includes a housing with terminal-receiving passages and female terminals therein. Each passage has a cross-section for receiving the terminal and cooperating therewith to prevent twisting of the terminal. The terminals each include an elongated planar body portion, a terminating portion extending rearwardly of the body portion and a contact portion extending forwardly of the body portion. The contact portion has a pair of laterally spaced-apart contact spring arms with mutually opposing contact portions defining a terminal-receiving mouth therebetween. The body portion includes a retention section having a pair of spaced-apart retention beams offset out of the plane of the body portion on opposite sides thereof.

35 Claims, 6 Drawing Sheets

ELECTRICAL CONNECTOR HAVING TERMINALS WITH IMPROVED RETENTION MEANS

FIELD OF THE INVENTION

This invention generally relates to the art of electrical connectors and, particularly, to an improved retention means or system for holding terminals in a connector housing.

BACKGROUND OF THE INVENTION

A known type of input/output (I/O) electrical connector includes a dielectric housing having a front mating face and a rear face with a terminal-receiving cavity means extending therebetween. A plurality of terminals are mounted in the housing, with portions of the terminals, such as female portions, extending outwardly of the dielectric housing for mating with the male terminals of a complementary mating connector. Often, the cavity means in the housing comprise a plurality of terminal-receiving passages extending between the front mating face and the rear face of the housing. Most often, the terminals have enlarged body sections which are used to fix the terminals within the passages in the housing so that the projecting mating portions of the terminals are maintained in proper spacing and alignment. The terminals typically are stamped and formed of conductive sheet metal material, and the enlarged body sections often are formed by retention barbs projecting outwardly of opposite edges of the stamped metal terminal.

An I/O connector of this type is shown in U.S. Pat. No. 4,740,180 dated Apr. 26, 1988 and assigned to the assignee of the present invention. That patent discloses a low insertion force mating electrical contact structure including a female terminal having a contact portion which includes laterally spaced-apart dual contact spring arms with mutually opposing contact portions defining a terminal-receiving mouth therebetween into which a male terminal is slidably received. In a preferred embodiment, the male terminal has a final contact portion with a forwardly extending lead-in portion which includes a gradual twisted cross-section relative to the final contact portion. With this mating contact structure, there is a tendency for the female terminal to twist about a longitudinal axis in a given direction.

Considerable problems continue to arise in designing I/O connectors of the character described above, because of the tendency in the electronics industry to demand miniaturized connectors having ever-increasing terminal densities. Typically, the terminals are densely arranged in the dielectric connector housing, leaving only a small amount of housing material between adjacent terminals. The housings typically are molded of plastic material. Terminal retention sections, such as the outwardly projecting retention barbs described above, must be wide enough that they slightly exceed the width of the closely spaced terminal-receiving passages in the housing, whereby the terminals are held in the housing by a press-fit, which results in transversely outwardly directed forces. In very dense terminal arrangements, this tends to crack the thin housing walls between the adjacent terminal passages. This is especially true with terminals that tend to twist upon insertion into the passages, such as with the female terminals in the aforementioned U.S. Pat. No. 4,740,180.

A related problem is encountered with the female terminals of the '180 patent wherein, as stated above, the female terminals have laterally spaced-apart dual contact spring arms with mutually opposing contact portions between which the male terminal is slidably received. With this construction, any twisting of the terminal tends to open the spacing between the dual contact spring arms. In actual practice, when the male terminal is inserted between the laterally spaced-apart dual contact spring arms, there is only a very small deflection expected (e.g., approximately 0.009 inch). This deflection is required to maintain the desired normal forces between the mating terminals. However, if the female terminal is allowed to twist within its respective passage in the connector housing, the spacing in the vertical plane between the dual contact spring arms will increase, resulting in a reduction in the amount of deflection of the arms upon mating, and, in turn, reducing the normal force between the mating contacts.

One solution to the above problems has been to insert mold the terminals in a dielectric insert to form a terminal module which, in turn, is mounted within a cavity in the connector housing. While this solves the retention problem, the overmolding process increases the cost of manufacturing such miniaturized connectors.

The present invention is directed to solving the above problems by providing a retention system which distributes the retention forces throughout the terminal array within the connector housing, and particularly a system which is highly effective with female terminals having spaced-apart dual contact spring arms.

SUMMARY OF THE INVENTION

An object, therefore, of the invention is to provide an electrical connector having a female terminal, of the type described above, with a new and improved terminal retention system.

In the exemplary embodiment of the invention, the female electrical terminal includes an elongated planar body portion with a tail portion extending rearwardly of the body portion and a contact portion extending forwardly of the body portion. The contact portion has laterally spaced-apart dual contact spring arms with mutually opposing contact portions defining a terminal-receiving mouth therebetween into which a male terminal is slidably received and resulting in a tendency to twist the terminal about a longitudinal axis in a given direction. The body portion includes a retention section adapted to resist the twisting of the terminal. The retention section includes laterally spaced-apart dual retention beams offset out of the plane of the body portion on opposite sides thereof. The beams have barbs on the lateral outside edges thereof for establishing an interference fit with portions of an appropriate housing to prevent twisting of the terminal. The beams may also have barbs on the lateral inner edges.

As disclosed herein, the dual contact spring arms are offset out of the plane of the body portion on opposite sides thereof in directions opposite the offset dual beams. This results in one contact spring arm and one beam being offset on opposite sides of the body portion along each opposite longitudinal edge of the terminal.

In one embodiment, the laterally spaced-apart offset dual beams also have barbs on the lateral inside edges thereof to facilitate retention and guiding the terminal into a passage of an appropriate connector housing. In addition, the body portion has retention barbs on lateral outside edges thereof between the retention section and the terminating portion, as well as retention barbs on lateral outside edges thereof between the retention section and the contact portion.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
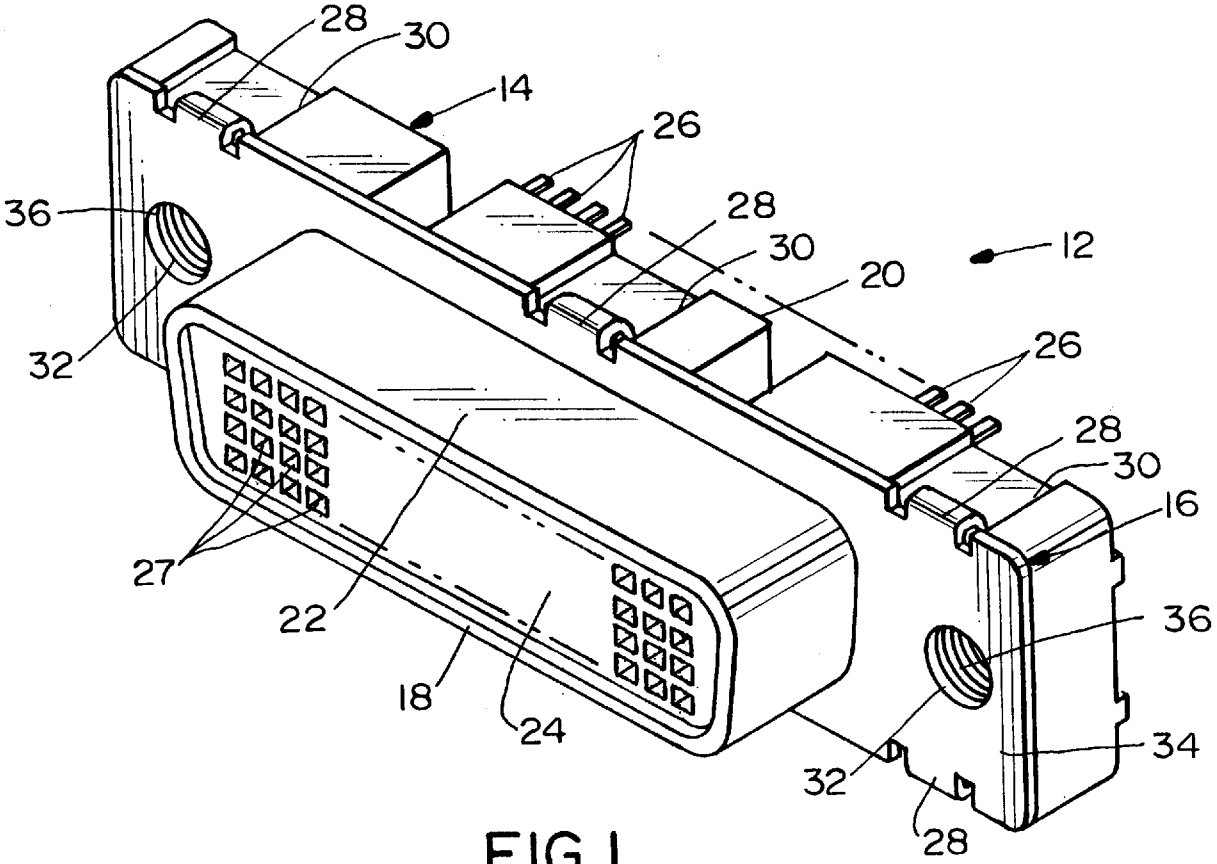
FIG. 1 is a perspective view of an electrical connector embodying the concepts of the invention.
Figure 3:
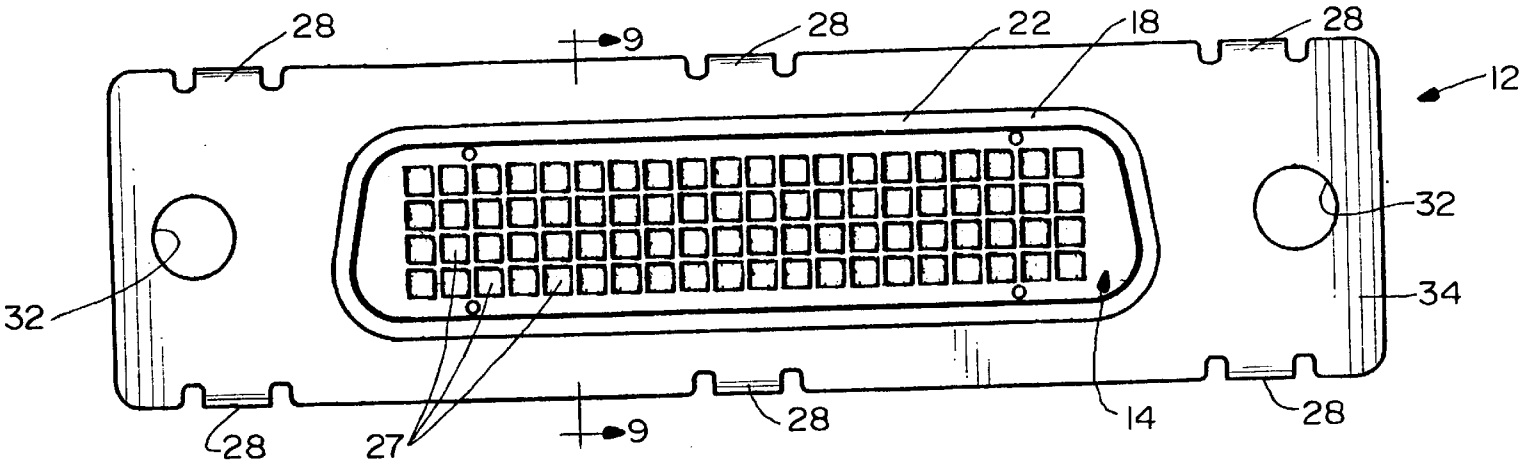
FIG. 3 is a front elevational view of the connector.
Figure 2:
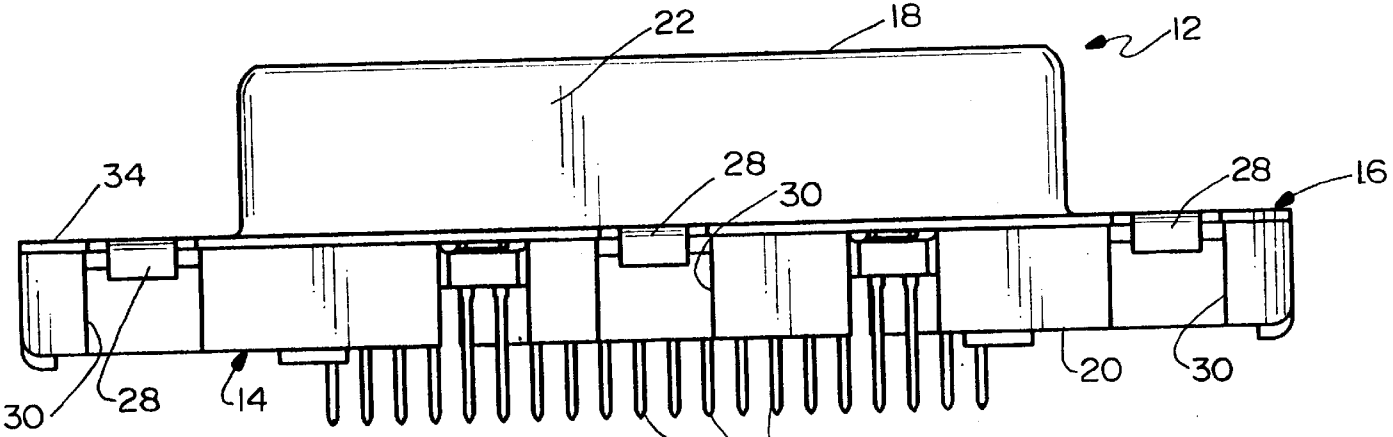
FIG. 2 is a top plan view of the connector.

Referring to the drawings in greater detail, and first to FIGS. 1–3, a first embodiment of the invention is shown in an electrical connector, generally designated 12, which includes an elongated dielectric housing, generally designated 14, and a front shield, generally designated 16. Housing 14 is a one-piece structure unitarily molded of dielectric material such as plastic or the like. Shield 16 is a one-piece structure stamped and formed of sheet metal material.

The connector is an input/output (I/O) electrical device with a D-shaped shroud portion 22 of the shield surrounding a complementarily shaped, forwardly projecting mating portion 24 of the housing within the shroud portion of the shield. Tail portions 26 of a plurality of terminals (described hereinafter) project rearwardly from rear face 20 of the connector for insertion into appropriate holes in a printed circuit board for connection to circuit traces on the board and/or in the holes. The terminals are inserted from the rear of the housing into a plurality of terminal-receiving passages, generally designated 27, which are also open at the front mating face of the housing for receiving the mating terminals of a complementary mating connector. As seen in FIG. 1, rearwardly formed tabs 28 of shield 16 embrace housing 14 within recesses 30 therein. Lastly, holes 32 in a flange 34 of shield 16 are aligned with internally threaded holes 36 of an insert within housing 14 for receiving appropriate threaded fasteners for fastening the connector to a complementary mating connector.

Figure 4:
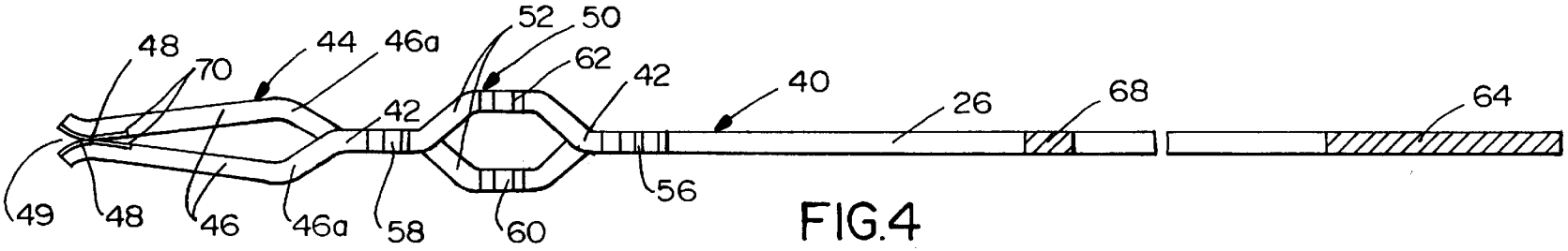
FIG. 4 is a side elevational view of one of the female terminals.
Figure 5:
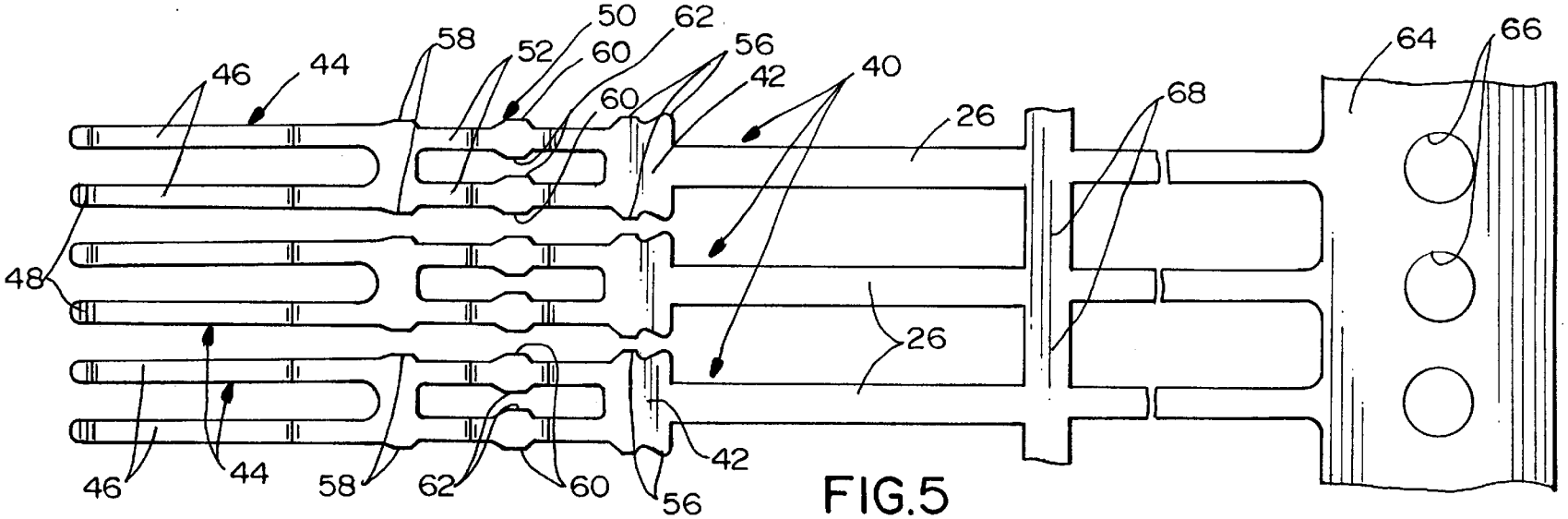
FIG. 5 is a plan view of a plurality of stamped blanks from which the female terminals are formed, with the blanks still being interconnected by a carrier strip of sheet metal material.
Figure 7:
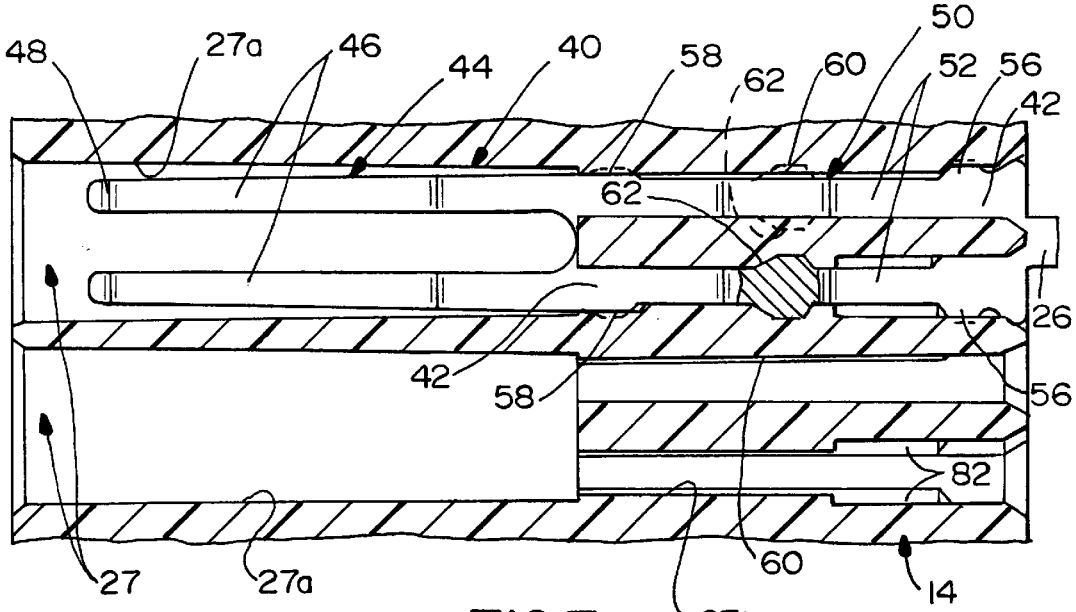
FIG. 7 is an axial section generally along line 7—7 of FIG. 6 through a pair of terminal-receiving massages in the housing, with one of the terminals inserted thereinto.

Referring to FIGS. 4 and 5 in conjunction with FIGS. 1–3, a plurality of female terminals, generally designated 40, are inserted into respective ones of the plurality of terminal-receiving passages 27 in dielectric housing 14. As stated above, the terminals are inserted into passages 27 through the rear face 20 of the connector such that contact portions (described below) of the terminals are disposed within forwardly projecting mating portion 24 of the housing and surrounded by shroud portion 22 of the shield. The terminating or tail portions 26 of the terminals project rearwardly of the housing as described above and shown in FIGS. 1 and 2.

Each female terminal 40 has an elongated planar body portion 42 extending between a forwardly extending contact portion, generally designated 44, and the rearwardly extending terminating or tail portion 26. As clearly seen in FIGS. 4 and 5, contact portion 44 includes a pair of laterally spaced-apart dual contact spring arms 46 having mutually opposing contact portions or surfaces 48 at the distal ends of the arms. Contact portions 48 are flared outwardly as best seen in FIG. 4 to define a terminal-receiving mouth 49 therebetween and into which a male terminal (not shown) is slidably received. For a better understanding of the terminal as further described hereinafter, it should be understood that insertion of the male terminal results in a tendency to twist female terminal 44 because of the lateral spaced-apart disposition of dual contact spring arms 46.

Body portion 42 of each female terminal 46 includes a retention section, generally designated 50, which is adapted to resist the twisting of the terminal when a male terminal is mated therewith. More particularly, retention section 50 includes a pair of laterally spaced-apart dual beams 52 which are offset out of the plane of body portion 42 on opposite sides thereof. Turning back to dual contact spring arms 46 of contact portion 44, it can be seen that the proximal ends of the spring arms are bowed outwardly, as at 46*a*, so that the dual contact spring arms also are offset outwardly relative to the plane of body portion 42.

As best seen in FIG. 4, dual contact spring arms 46 are offset out of the plane of body portion 42 on opposite sides of the body portion in directions opposite the offset dual beams 52. In other words, one contact spring arm 46 and one beam 52 that are generally linear are offset on opposite sides of the plane of body portion 42 along each opposite longitudinal edge of the terminal. This results in the beams resisting or preventing twisting of the terminal when a mating male terminal is inserted between the laterally spaced-apart dual contact spring arms 46, as will be better understood hereinafter when describing the position of the terminal within its respective terminal-receiving passage in the housing.

Each female terminal 40 is stamped and formed of conductive sheet metal material, whereby planar body portion 42 has lateral outside edges. The body portion has rear retention barbs 56 on the lateral outside edges thereof between retention section 50 and tail portion 26. The body portion also has forward retention barbs 58 on the lateral outside edges thereof between retention section 50 and contact portion 44 thereof. The distance across rear retention barbs 56 is greater than the distance across forward retention barbs 58 for reasons explained in detail below. Beams 52 of retention section 50 have retention barbs 60 on the lateral outside edges thereof. Beams 52 of the retention section may also have barbs 62 on the lateral inside edges thereof. All of barbs 56, 58, 60 and 62 are provided for establishing an interference fit with portions of housing 14 within a respective one of the terminal-receiving passages 27. Inside barbs 62 on beams 52 may be deleted, if desired.

As best seen in FIG. 5, terminals 40 are fabricated by stamping and forming the terminals from conductive sheet metal material, with the terminals joined to a carrier strip 64 having indexing holes 66 as is known in the progressive stamping and forming art. Tail portions 26 of the terminals are joined by metal webs 68 to hold the terminals in proper position and spacing during ancillary operations, such as plating. For instance, FIG. 4 shows that opposing contact portions 48 of dual contact spring arms are selectively plated, as at 70, with a noble metal material, such as gold, different from the base material of the terminal.

Figure 6:
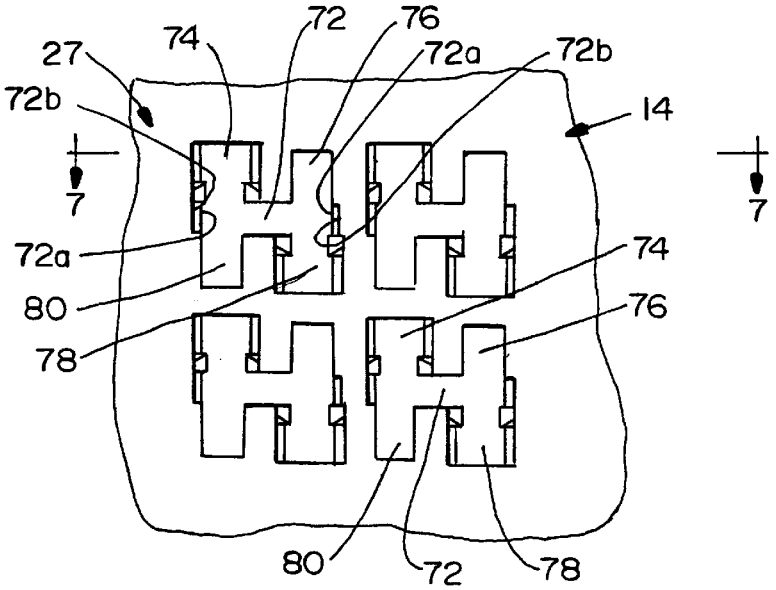
FIG. 6 is a rear elevational view of four of the terminal-receiving passages of the housing, with lead-in at he rear of the housing removed for clarity.

Referring to FIGS. 6–9 and first to FIG. 6, a rear view of four of the terminal-receiving passages 27 in dielectric housing 14 is shown. These terminal-receiving passages 27 are divided into two sections 27. The first or forward section 27*a* extends rearwardly from the front of the housing to approximately the midpoint of the housing and the second or rear section 27*b* extends between the first section and the rear face of the housing. The lengths of these sections are determined by the length of the various structural elements of the terminals 40. The contact section 44 of each terminal 40 is located within forward section 27*a* of terminal receiving passage 27 and the body portion 42 of each terminal is located in the rear section.

The transverse configuration of the rear section 27*b* of each passage is generally that of an "H." In other words, each H-shaped passage includes a connecting section 72 and four leg sections 74, 76, 78 and 80. In essence, each leg section 74–80 of each H-shaped passage defines a quadrant of the passage for receiving one of the laterally spaced-apart dual contact spring arm 46 or one of the laterally spaced-apart dual beams 52 of a respective one of terminals 40. Connecting section 72 is configured to receive planar body portion 42 of the terminal. Each of retention leg sections 74 and 78 secures one of beams 52 therein as described in further detail below and clearance leg sections 76 and 80 are dimensioned to permit contact portions 44 to pass therethrough.

Each of retention leg sections 74 and 78 is divided into two sections or chambers. The first or entrance chambers 74*a* and 78*a* are located adjacent the rear face of the housing and have a width slightly larger than the width across retention section 50 between retention barbs 60 and 62 to permit the barbs to pass through such entrance chamber without interference. The second or retention chambers 74*b* and 78*b* are located between the entrance chambers 74*a* and 78*a* and the forward section 27*a* of terminal-receiving passage 27. These retention chambers 74*b* and 78*b* have a width less than the width across retention section 50 between retention barbs 60 and 62 so that an interference fit is created between the retention barbs and the retention chamber when the terminals are fully inserted into passages 27.

Retention leg sections 74 and 78 are separated from connecting section 72 by elongated ribs 82 that are spaced inward from the rear of the housing and extend approximately to the midpoint of the housing. These ribs 82 guide and properly position the beams 52 as the terminals are inserted into the housing in order to ensure that the contact portions 44 are properly positioned prior to securing the terminals in place within the housing. The horizontal distance between the ribs 82 is slightly less than the width of beams 52 upon which retention barbs 60 and 62 are located in order to permit the beams to pass between such ribs 82 without interference. The vertical distance "d" between ribs 82 and the top surface 75 of retention leg section 74 (or the bottom surface 79 of section 78) is slightly greater than the thickness of the beams 52 and barbs 60 and 62 in order to properly position the terminals 40 during assembly and to prevent twisting of the terminals during mating.

Although the terms vertical and horizontal are used herein, the electrical connectors and the concepts disclosed herein are omni-directional, as would be known to one skilled in the art. Accordingly, the terms vertical and horizontal as well as other directional terms are used to indicate relative position and should not be considered limiting.

Connecting section 72 of terminal-receiving passage 27 is configured to receive planar body portion 42 of each terminal. More particularly, connecting section 72 is divided into two sections, forward section 72*a* and rear section 72*b*. Both sections 72*a* and 72*b* have the same height, which is slightly greater than the thickness of body portion 42 of terminal 40, in order to properly position the terminals 40 during assembly and to prevent twisting movement of the terminals during mating. Rear section 72*b* is wider horizontally than forward section 72*a*. Rear section 72*b* is dimensioned so as to be wider than the distance across forward barbs 58 to permit the barbs to pass therethrough and narrower than the distance across rear barbs 56 so that the rear barbs are captured in the rear section 72*b* in an interference fit. The forward section 72*a* is narrower than the distance across forward barbs so that the forward barbs may be captured therein in an interference fit.

During assembly, the terminals 40 are inserted into passages 27 from the rear of the housing 14. The contact portions 44 pass through clearance leg sections 76 and 80 and into the forward section 27*a* of each terminal receiving passage 27. As the terminal 40 continues to advance, the barbs 60 and 62 of beams 52 ride up lead-in 82*a* of ribs 82 so that the barbs 60 and 62 are positioned within entrance chambers 74*a* and 74*b* of terminal retention passages 74 and 78. In addition, the forward portion of body 42 slides within rear section 72*b* of connecting section 72 of passage 27. Eventually, the barbs 60 and 62 of beams 52 begin to engage the retention chambers 74*b* and 78*b* of passages 74 and 78 in an interference fit, skiving into the plastic housing. As the terminal continues to be inserted into passage 27, the forward barbs 58 of body 42 engage forward section 72*a* of connecting section 72 in an interference fit. Finally, the rear barbs 56 of body 42 engage rear section 72*b* of connecting section 72, also in an interference fit. In other words, the terminals are retained within the housing by interference fits along barbs 56, 58, 60 and 62 with barbs 60 and 62 engaging first, forward barbs 58 engaging second and rear barbs 56 engaging last. It should be noted, however, that the primary retention is provided by barbs 60 and 62.

Figure 8:
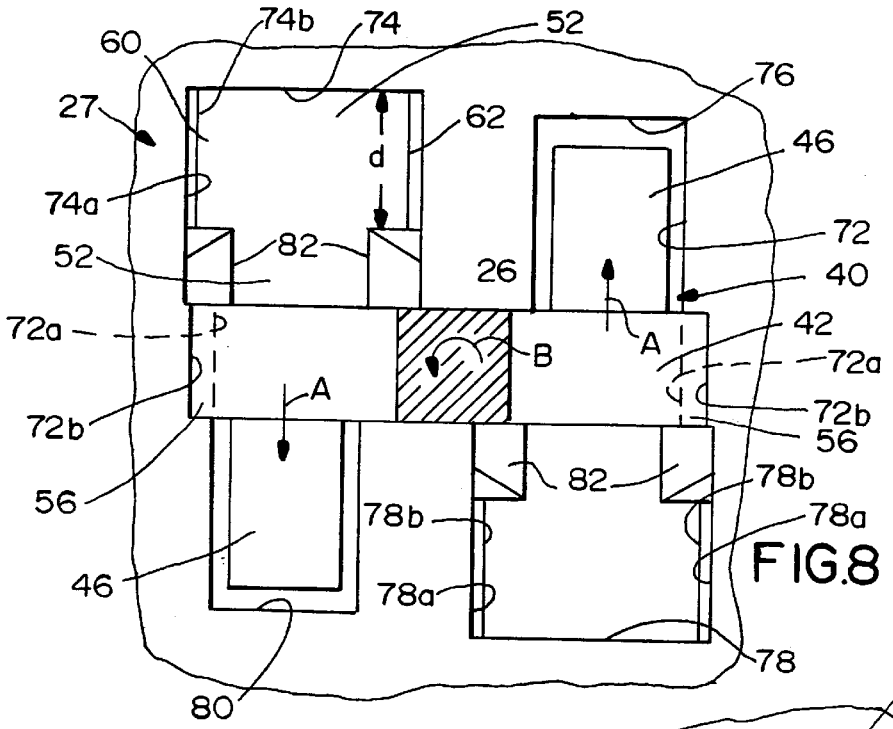
FIG. 8 is an enlarged rear elevational view of one of the terminal-receiving passages, with one of the terminals disposed therein and with lead-in at the rear of the housing removed for clarity.

Referring to FIG. 8, it can be understood how oppositely offset beams 52 of the retention section 50 of the terminal resist twisting movement of the terminal about its longitudinal axis when a male terminal is mated with the female terminal. In particular, when a male terminal is inserted into mouth 49 (FIG. 4) of the terminal between laterally spaced-apart dual contact spring arms 46, the contact spring arms tend to spread apart in the direction of arrows "A" (FIG. 8). This creates a tendency for the terminal to rotate or twist in the direction of curved arrow "B." However, with barbs 60 on the lateral outside edges of beams 52 establishing an interference fit with walls of retention leg sections 74 and 78, respectively, of the passage as seen clearly in FIG. 8, this twisting movement of the terminal is opposed and substantially prevented. In addition, connecting section 72 also engages body 42 of terminal 40 to prevent twisting movement of the contact spring arms. Consequently, with no twisting movement of the terminal, full normal forces are applied by dual contact spring arms 46 onto opposite sides of the mating male terminal.

Figure 10:
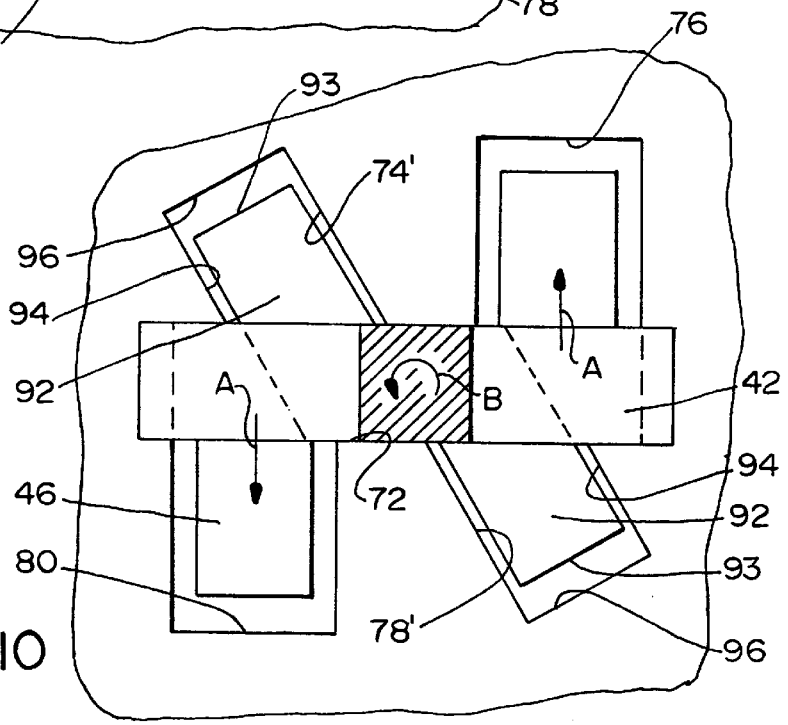
FIG. 10 is a view similar to that of FIG. 8, but of an alternate embodiment of the invention.
Figure 11:
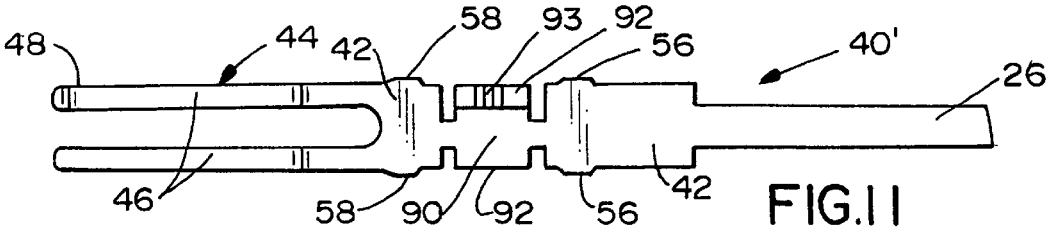
FIG. 11 is a plan view of one of the terminals of the alternate embodiment of the invention.

FIGS. 10 and 11 show an alternate embodiment of the invention. In particular, FIG. 10 is similar to FIG. 8 of the first embodiment to the extent that a terminal-receiving passage 27' includes clearance leg sections 76 and 80 for through which laterally spaced-apart dual contact spring arms 46 of a terminal 40' pass. However, the other two legs or sections 74' and 78' of the passage are oblique to connecting section 72 of the passage. In other words, the passage 27' has a modified H-shaped cross-section.

Figure 9:
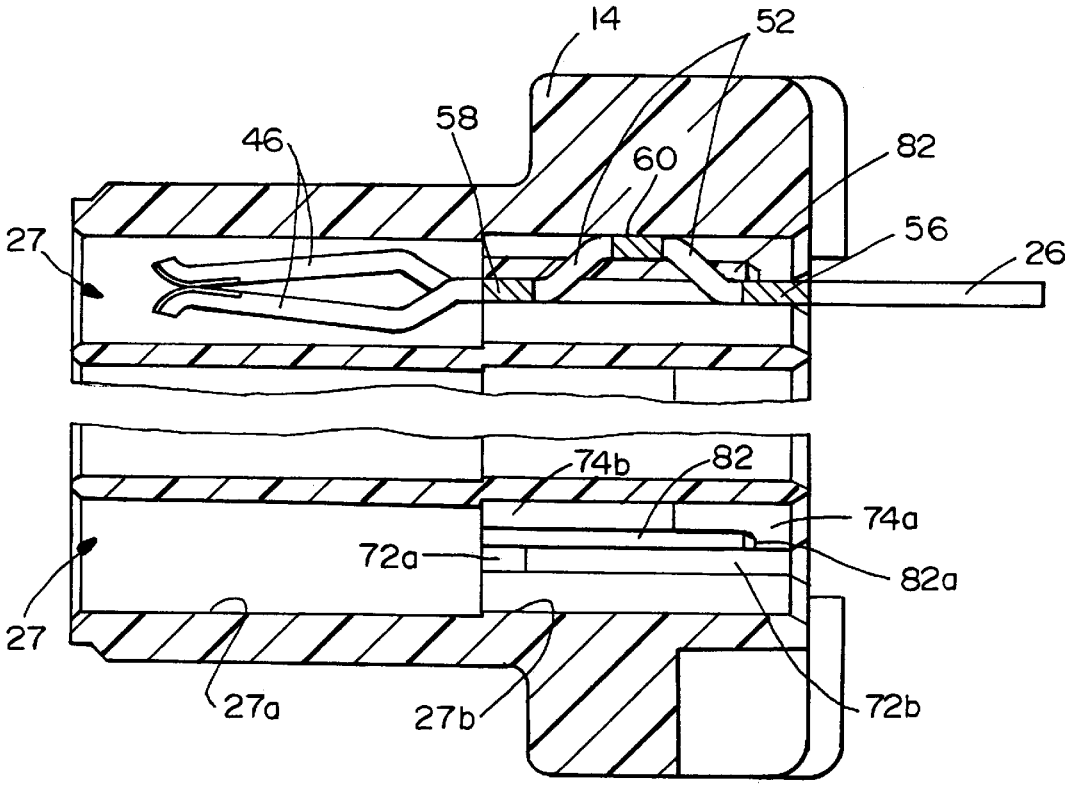
FIG. 9 is a fragmented section generally along line 9—9 of FIG. 3, with only one terminal shown for clarity.

FIG. 11 shows a modified female terminal 40' for insertion into the modified passage 27' shown in FIG. 9. Like female terminal 40, female terminal 40' has a rearwardly projecting tail portion 26 and a forwardly projecting contact portion, generally designated 44, defined by a pair of laterally spaced-apart dual contact spring arms 46. Again, the spring arms have mutually opposing contact portions 48 at their distal ends. Also, modified female terminal 40' also has an elongated planar body portion 42 including retention barbs 56 and 58.

The difference between modified female terminal 40' (FIG. 11) and female terminal 40 (FIGS. 4 and 5) is that the modified terminal has a twisted retention section 90 with beams or portions stamped and formed out of body portion 42. The twisted retention section defines oblique portions or beams 92 which project into quadrants 74' and 78' of modified passage 27 shown in FIG. 9 and described above. In other words, beams 92 replace oppositely offset dual beams 52 of the first embodiment. Retention beams 92 have barbs 93 on the outer edges thereof.

The functional operation of modified female terminal 40' in FIG. 9 is similar to the operation of female terminal 40 described above in relation to FIG. 8, in that both terminals are designed to resist or oppose twisting movement of the terminal. In other words, insertion of a mating male terminal between dual contact spring arms 46 of modified terminal 40' again separates the spring arms in the direction of arrows "A" (FIG. 9) which, in turn, tends to twist modified terminal 27' in the direction of curved arrow "B." Twisted retention beams 92 engage side walls 94 of quadrants 74' and 78' of the passage, and barbs 93 on the beams engage end walls 96 of quadrants 74' and 78' of the passage, to prevent twisting movement of the terminal and to maintain full normal forces between dual contact spring arms 46 and the inserted male terminal. In addition, body 42 also engages connecting section 72 to prevent twisting movement of the spring contact arms 46.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A female electrical terminal, comprising:

an elongated generally planar body portion;

a terminating portion extending rearwardly of the body portion;

a contact portion extending forwardly of the body portion, the contact portion having a pair of contact spring arms spaced apart in a first direction generally parallel to the plane of the body portion and spaced apart in a second direction generally perpendicular to the first direction with mutually opposing contact portions defining a terminal-receiving mouth therebetween into which a male terminal is slidably received and resulting in a tendency to twist the terminal about a longitudinal axis in a given direction; and the body portion including a retention section having a plurality of barbs longitudinally spaced along the terminal between the contact portion and the terminating portion, the retention section including a pair of laterally spaced-apart beams offset out of the plane of the body portion on opposite sides thereof, the beams having at least one of the barbs for establishing an interference fit with portions of an appropriate housing to prevent said twisting of the terminal.

2. The female electrical terminal of claim 1 wherein said pair of contact spring arms are offset out of the plane of the body portion on opposite sides thereof in directions opposite the pair of offset beams whereby one contact spring arm and one beam are offset on opposite sides of the plane of the body portion along each opposite longitudinal edge of the terminal.

3. The female electrical terminal of claim 1 wherein said beams have barbs on the lateral inside edges thereof.

4. The female electrical terminal of claim 1 wherein said body portion has retention barbs on lateral outside edges thereof between said retention section and said terminating portion.

5. The female electrical terminal of claim 1 wherein said body portion has retention barbs on lateral outside edges thereof between said retention section and said contact portion.

6. The female electrical terminal of claim 5 wherein said body portion has retention barbs on lateral outside edges thereof between said retention section and said terminating portion.

7. The female electrical terminal of claim 1 wherein said pair of laterally spaced-apart beams are stamped and formed out of the body portion of the terminal.

8. The female electrical terminal of claim 2 wherein said beams have barbs on the lateral inside edges thereof.

9. The female electrical terminal of claim 2 wherein said body portion has retention barbs on lateral outside edges thereof between said retention section and said terminating portion.

10. The female electrical terminal of claim 2 wherein said body portion has retention barbs on lateral outside edges thereof between said retention section and said contact portion.

11. The female electrical terminal of claim 10 wherein said body portion has retention barbs on lateral outside edges thereof between said retention section and said terminating portion.

12. The female electrical terminal of claim 2 wherein said pair of laterally spaced-apart beams are stamped and formed out of the body portion of the terminal.

13. An electrical connector, comprising:

a plurality of stamped and formed metal terminals, each terminal including an elongated, generally planar body portion, a terminating portion extending rearwardly of the body portion, a contact portion extending forwardly of the body portion and including a pair of contact spring arms spaced apart in a first direction generally parallel to the plane of the body portion and spaced apart in a second direction generally perpendicular to the first direction with mutually opposing contact portions defining a terminal-receiving mouth therebetween into which a male terminal is slidably received, and a retention section including retention barbs between said terminating portion and said contact portion, said retention section including a pair of laterally spaced-apart beams which are offset out of the plane of the body portion on opposite sides thereof in directions opposite the pair of contact spring arms whereby one beam and one contact spring arm are offset on opposite sides of the plane of the body portion along each opposite longitudinal edge of the terminal; and a dielectric housing having a plurality of terminal receiving passages therein, a portion of said passages being generally H-shaped, each H-shaped portion including a central connecting section for receiving the generally planar body portion of each terminal, a first pair of diagonally disposed clearance leg sections through which the laterally spaced-apart contact spring arms of each terminal pass during insertion of said terminal into said passage, and a second pair of diagonally disposed leg sections for receiving the laterally spaced-apart beams of each terminal and wherein outer edges of the beams engage walls of said lea sections in order to minimize rotation of said terminal.

14. The electrical connector of claim 13, wherein said retention beams create an interference fit with said retention leg sections.

15. The electrical connector of claim 13, wherein said housing further includes a rib between said connecting section and said retention leg section.

16. The electrical connector of claim 15, wherein said ribs are spaced from a rear face of said housing.

17. The electrical connector of claim 13, wherein said housing further includes a pair of spaced apart ribs between said connecting section and said retention leg section.

18. The electrical connector of claim 17, wherein said ribs are spaced from a rear face of said housing.

19. The electrical of connector claim 13, wherein said retention beams have a thickness and said retention leg section of said housing has a height, said thickness being approximately equal to said height.

20. The electrical connector of claim 13, wherein said body portion of each said terminal has forward retention barbs on lateral outside edges thereof between said retention section and said contact portion and rear retention barbs on said lateral outside edges between said retention section and said terminating portion, said retention beams, forward retention barbs and said rear retention barbs each engage said housing with an interference fit.

21. The electrical connector of claim 20, wherein said housing and terminals are dimensioned so that during insertion of said terminals into said housing, said retention beams skive into said retention section of said housing first, said forward retention barbs skive into said connecting section second and said rear retention barbs skive into said connecting section last.

22. The electrical connector of claim 13, wherein each said retention leg section is at a first angle relative to said connecting section and each said retention leg section is at a second angle relative to said connecting section.

23. The electrical connector of claim 22, wherein said first and second angles are equal.

24. The electrical connector of claim 22, wherein said first and second angles are unequal.

25. An electrical connector, comprising:

a plurality of stamped and formed metal female terminals, each terminal including an elongated, generally planar body portion, a tail portion extending rearwardly of the body portion, a contact portion extending forwardly of the body portion and including a pair of contact spring arms spaced apart in a first direction generally parallel to the plane of the body portion and spaced apart in a second direction generally perpendicular to the first direction with mutually opposing contact portions defining a terminal-receiving mouth therebetween into which a male terminal is slidably received, and a retention section having a plurality of barbs spaced longitudinally along the terminal between said tail portion and said contact portion, a pair of said retention beams being laterally spaced apart and offset out of the plane of the body portion on opposite sides thereof; and a dielectric housing having a plurality of terminal receiving passages therein, a rear portion of said passages receiving said terminal retention section, each passage rear portion including a central connecting section for receiving the generally planar body portion of each terminal, a pair of diagonally disposed retention leg sections for receiving the laterally spaced-apart retention beams of each terminal, the retention beams each having barbs for engaging the housing within the terminal receiving passages in an interference fit.

26. The electrical connector of claim 25, wherein said housing further includes a rib between said connecting section and said retention leg section.

27. The electrical connector of claim 25, wherein said ribs are spaced from a rear face of said housing.

28. The electrical connector of claim 25, wherein said housing further includes a pair of spaced apart ribs between said connecting section and said retention leg section.

29. The electrical connector of claim 28, wherein said ribs are spaced from a rear face of said housing.

30. The electrical connector of claim 25, wherein said retention beams have a thickness and said retention leg section of said housing has a height, said thickness being no greater than said height.

31. The electrical connector of claim 25, wherein said body portion of each said terminal has forward retention barbs on lateral outside edges thereof between- said retention section and said contact portion and rear retention barbs on said lateral outside edges between said retention section and said terminating portion, said retention beams, forward retention barbs and said rear retention barbs each engage said housing with an interference fit.

32. The electrical connector of claim 31, wherein said housing and terminals are dimensioned so that during insertion of said terminals into said housing, said retention beams skive into said retention section of said housing first, said forward retention barbs skive into said connecting section second and said rear retention barbs skive into said connecting section last.

33. The electrical connector of claim 25, wherein each said retention leg section is at a first angle relative to said connecting section and each said retention leg section is at a second angle relative to said connecting section.

34. The electrical connector of claim 33, wherein said first and second angles are equal.

35. The electrical connector of claim 33, wherein said first and second angles are unequal.

* * * * *